US011090620B2

(12) United States Patent
Tanaka et al.

(10) Patent No.: US 11,090,620 B2
(45) Date of Patent: Aug. 17, 2021

(54) DEVICE FOR COUNTER COLLISION TREATMENT INCLUDING NOZZLE ADJUSTMENT MEANS

(71) Applicant: CHUETSU-PULP AND PAPER CO., LTD., Takaoka (JP)

(72) Inventors: Hiroyuki Tanaka, Takaoka (JP); Tsugutoshi Nakada, Takaoka (JP)

(73) Assignee: CHUETSU-PULP AND PAPER CO., LTD., Toyama (JP)

( * ) Notice: Subject to any disclaimer, the term of this patent is extended or adjusted under 35 U.S.C. 154(b) by 212 days.

(21) Appl. No.: 16/301,958

(22) PCT Filed: May 12, 2017

(86) PCT No.: PCT/JP2017/018055
§ 371 (c)(1),
(2) Date: Nov. 15, 2018

(87) PCT Pub. No.: WO2017/199876
PCT Pub. Date: Nov. 23, 2017

(65) Prior Publication Data

US 2019/0184348 A1 Jun. 20, 2019

(30) Foreign Application Priority Data

May 16, 2016 (JP) ..... JP2016-097865

(51) Int. Cl.
*B01F 5/02* (2006.01)
*B02C 19/06* (2006.01)
(Continued)

(52) U.S. Cl.
CPC ..... *B01F 5/02* (2013.01); *B01F 5/0256* (2013.01); *B02C 19/06* (2013.01); *D21B 1/30* (2013.01); *D21H 11/18* (2013.01)

(58) Field of Classification Search
CPC .. B01F 5/02; B01F 3/0807; B01F 5/10; B01F 5/0256; B01F 5/025; B01F 5/0262;
(Continued)

(56) References Cited

U.S. PATENT DOCUMENTS 2,502,778 A * 4/1950 Collins ..... B01F 5/0256 366/105
4,289,732 A * 9/1981 Bauer ..... B01F 5/0471 239/543

(Continued)

FOREIGN PATENT DOCUMENTS

EP 1618959 A1 * 1/2006
WO WO-2017199876 A1 * 11/2017

*Primary Examiner* — Charles Cooley
(74) *Attorney, Agent, or Firm* — Sughrue Mion, PLLC

(57) ABSTRACT

A device and method for counter collision treatment. The device includes: first and second nozzles oppositely disposed so as to inject jets of a highly pressurized fluid into a body protective ring; the injection directions of the first and second nozzles are determined so as to intersect with an angle at one point located in front of the nozzle orifices thereof. Further, the jets from the first and second nozzles are caused to collide with each other to thereby effect homogenization of the fluid by impact-fragmentation. Yet further, one of the first and second nozzles is provided with a turning mechanism for enabling the nozzle to turn around the fixed injection direction as the axis of the turn while keeping the injection direction unchanged.

6 Claims, 5 Drawing Sheets

(51) Int. Cl.
*D21B 1/30* (2006.01)
*D21H 11/18* (2006.01)

(58) Field of Classification Search
CPC ..... B02C 19/06; B02C 19/065; B02C 19/063; D21B 1/30; D21H 11/18; D21D 1/34
USPC ..... 366/162.4
See application file for complete search history.

(56) References Cited

U.S. PATENT DOCUMENTS

| | | | | |
|---|---|---|---|---|
| 4,768,721 | A * | 9/1988 | Niemi | B02C 19/065 241/39 |
| 10,857,507 | B2 * | 12/2020 | Vellaiah Retnaswamy | B05B 15/65 |
| 2006/0109738 | A1 * | 5/2006 | Buchholz | B01F 5/0077 366/162.4 |

* cited by examiner 15
1
2
3
4
5
6a
6b
7a
7b
8a
8b
9
10a
10b
11a
11b
12a
12b
13a
13b
14a
14b
16b
17
18b
19a
19b

DEVICE FOR COUNTER COLLISION TREATMENT INCLUDING NOZZLE ADJUSTMENT MEANS

CROSS REFERENCE TO RELATED APPLICATIONS

This application is a National Stage of International Application No. PCT/JP2017/018055 filed May 12, 2017, claiming priority based on Japanese Patent Application No. 2016-097865 filed May 16, 2016.

TECHNICAL FIELD

The present invention relates to a device for counter collision treatment which carries out, by utilizing collision between jets of a fluid, homogenization of the fluid such as emulsification of the fluid or dispersion of minute particles in the fluid and/or atomization of particles in the fluid by the impact-fragmentation (fragmentation by means of the collision between jets of a fluid).

BACKGROUND ART

It is known that cellulose is produced as a fibrous form in nature by plants, for example, woody plants such as hardwoods and softwoods, and herbaceous plants such as bamboo and reed, some animals typified by sea squirt, and some fungi typified by acetobacter, and the like. Cellulose molecules having a structure of aggregate in a fibrous form are called a cellulose fiber. In particular, a cellulose fiber having a fiber width of 100 nm or less and an aspect ratio of 100 or more is generally called a cellulose nanofiber (hereinafter referred to as CNF) and has excellent properties such as light weight, high mechanical strength and low coefficient of thermal expansion.

In nature, a CNF does not exist in the form of a single fiber except those produced by some fungi typified by acetobacter. Most of CNFs exist in a firmly aggregated form by interaction typified by hydrogen bonding between CNFs, which form has a micro-size fiber width. Fibers having such a micro-size fiber width exist in a further highly aggregated form.

In a papermaking process, wood is fibrillated by a pulping method typified by a kraft cooking method as one of chemical pulping methods to a state of pulp having a micro-size fiber width, and paper is prepared using the pulp as a starting material. The fiber width of pulp varies depending upon a starting material and is about 5-20 μm, about 20-80 μm and about 5-20 μm with respect to bleached hardwood kraft pulp, bleached softwood kraft pulp and bleached bamboo kraft pulp, respectively.

As described above, such pulp having a micro-size fiber width is an aggregate of single fibers which has a fibrous form and in which CNFs are firmly aggregated by interaction typified by hydrogen bonding, and CNFs as single fibers having a nano-size fiber width are obtained by further advancing fibrillation.

An aqueous counter collision method as a mechanical method for preparing a CNF is such a technique, as disclosed in Patent Document 1, that natural cellulose fibers suspended in water are introduced into opposing two nozzles (FIG. 4: 108*a*, 108*b*) in a chamber (FIG. 4: 107) and jetted from these nozzles toward one point and thereby caused to collide (see FIG. 4). With this method, jets of an aqueous suspension of natural microcrystalline cellulose fibers (for example, Funacell manufactured by Funakoshi Co., Japan) are counter-collided to nano-fibrillate and thereby strip off surfaces of the fibers. This improves affinity of the fibers for water as a carrier and thereby enables the nano-fibrillated fibers to be finally brought to a nearly dissolved state. The device shown in FIG. 4 is of a liquid circulation type and comprises a tank (FIG. 4: 109), a plunger (FIG. 4: 110), opposing two nozzles (FIG. 4: 108*a*, 108*b*) and, if desired, a heat exchanger (FIG. 4: 111). In the device, fine particles dispersed in water are introduced into the opposing two nozzles (FIG. 4: 108*a*, 108*b*) and jetted from the opposing nozzles (FIG. 4: 108*a*, 108*b*) under high pressure to cause the fine particles to counter collide in water. In this method, only water is used other than natural cellulose fibers, and nano-fibrillation is effected by cleaving only interaction between the fibers, and hence no substantial structural change of cellulose molecules is caused. Accordingly, it is possible to obtain a nano-fibrillated product with lowering of polymerization degree of cellulose associated with the cleavage minimized.

In relation to the device for counter collision treatment used in the aqueous counter collision method disclosed in Patent Document 1, with a main aim to provide a device for counter collision treatment improved in minimization of damage to an emulsifying section and, in particular, prevention of the jets from directly impinge against nozzles, and with a further aim to improve efficiency in effecting emulsification/dispersion by collision between fluid jets and/or atomization of particles in the fluid by impact-fragmentation (fragmentation utilizing collision between fluid jets), Patent Document 2 discloses a device for counter collision treatment which comprises a housing provided with an internal chamber, and first and second nozzle means so attached to the housing as to inject jets of a highly pressurized fluid into the internal chamber, and injection directions of the first and second nozzle means are so determined that the jets therefrom intersect with an angle at one point located in front of the nozzle orifices thereof; and the device is characterized in that at least one of the first and second nozzle means is provided with an adjusting mechanism for adjusting injection direction thereof.

PRIOR ART DOCUMENTS

Patent Documents

Patent Document 1: Japanese Unexamined Patent Publication No. 2005-270891

Patent Document 2: Japanese Patent No. 3151706

SUMMARY OF THE INVENTION

Problem to be Solved by the Invention

However, although the device disclosed in Patent Document 2 is provided with the adjustment mechanism for adjusting the injection direction of at least one of the first and second nozzle means, there is a problem that the adjustment of the injection direction by means of such an adjustment mechanism may be laboratorially or experimentally possible but is extremely inefficient when actually carried out in an industrial production line.

Specifically, it is in itself difficult to manually perform extremely delicate angular adjustment of the injection direction. Further, it is practically impossible to manually find out the optimum angle and manually fix the injection direction at the optimum angle found out.

In view of the above-described problem in the conventional technique, it is an object of the present invention to provide a device for counter collision treatment which carries out, by means of collision between jets of a fluid, homogenization of the fluid such as emulsification of the fluid or dispersion of minute particles in the fluid and/or atomization of particle in the fluid by impact-fragmentation, i.e., fragmentation utilizing the collision between the jets of a fluid, which exhibits improved efficiency in atomization of particles by means of collision between jets of a fluid and which can actually be applied to implementation in an industrial production line conveniently.

Means to Solve the Problem

Accordingly, the present invention provides a device for counter collision treatment which comprises: a first nozzle means and a second nozzle means that are oppositely disposed so as to inject jets of a highly pressurized fluid into the body protective ring; injection directions of the first and second nozzle means are so determined that the jets therefrom intersect with an angle at one point located in front of the nozzle orifices thereof; and the jets of the highly pressurized fluid injected from the first and second nozzle means are caused to collide with each other to thereby effect homogenization of the fluid such as emulsification of the fluid or dispersion of minute particles in the fluid and/or atomization of particles in the fluid by impact-fragmentation, i.e., fragmentation utilizing the collision between the jets of a fluid; characterized in that one of the first and second nozzle means is fixedly disposed and the other is provided with a turning mechanism for enabling the other to turn around the fixed injection direction as the axis of the turn while keeping the injection direction unchanged.

As described above, the turning mechanism for enabling the other to turn around the fixed injection direction as the axis of the turn while keeping the injection direction unchanged is provided, thereby enabling the nozzle provided with the turning mechanism to turn while keeping the injection direction unchanged. This enables the jet from the nozzle provided with the turning mechanism to collide with the jet from the fixed nozzle at the optimum point. As a result, the jets of a highly pressurized fluid injected from the first and second nozzle means collide with each other with an angle at one point in the body protective ring. By the impact force resulting from this collision, homogenization of the fluid and/or atomization of particles in the fluid is effected.

The nozzle means provided with the turning mechanism may be disposed eccentrically apart from the position at which the highly pressurized fluid is jetted toward the one point substantially on the central axis of the body protective ring.

Due to the eccentric placement, jets injected from the first and second nozzle means may not collide with each other at the start. However, the eccentrically disposed nozzle means is permitted to turn during operation. Accordingly, it is possible to easily adjust the position of the eccentrically disposed nozzle means to that for the optimum collision using a tool such as a driver while continuing the operation.

The body protective ring may be provided with through holes on extensions of the injection directions from the first and second nozzle means. Consequently, even if jets injected from the first and second nozzle means do not collide with each other at the start, the jetted fluid is discharged to the outside via the through holes located on the extensions of the injection directions. Under observation of the discharge amount of the jetted fluid, by turning the nozzle means provided with the turning mechanism while keeping the injection direction unchanged, the optimum position for the desired collision with the jet from the fixed nozzle means can be found out.

The body protective ring may be provided with pressure sensors downstream from the extensions of the injection directions from said first and second nozzle means or at appropriate positions downstream of the through holes formed on the extensions of the injection directions. Based on signals from the pressure sensors, the optimum point can digitally be found out.

Further, by constantly monitoring the signals from the pressure sensors, undesired conditions such as dislocation of the collision point due to abrasion of muzzle means or the like can be detectable.

The atomization of particles in a fluid by means of the device for counter collision treatment according to the present invention is applicable to various materials, for example, polysaccharide slurries of pulp or natural cellulose fibers suspended in water, and other materials such as foods, cosmetics, drugs, coating materials, ceramics, electronic materials.

Further, the present invention provides a method for counter collision treatment which comprises:

oppositely disposing a first nozzle means and a second nozzle means so as to inject jets of a highly pressurized fluid into the body protective ring;

determining injection directions of said first and second nozzle means so that the jets therefrom intersect with an angle at one point located in front of the nozzle orifices thereof; and causing the jets of the highly pressurized fluid injected from said first and second nozzle means to collide with each other;

characterized in that one of said first and second nozzle means is fixedly disposed and the other is permitted to turn around the fixed injection direction as the axis of the turn while keeping the injection direction unchanged, thereby specifically finding out the collision point between the jets from said first and second nozzle means.

As the nozzle means, known nozzles capable of jetting a highly pressurized fluid may be used.

Effect of the Invention

The device for counter collision treatment according to the present invention exhibits improved efficiency in atomization of particles in a fluid by means of collision between jets of a fluid and can actually be used in an industrial production line conveniently.

BRIEF DESCRIPTION OF DRAWINGS

FIG. 1(*b*) is a side view of the embodiment of the device for counter collision treatment shown in FIG. 1(*a*);

FIG. 3(*a*) shows general configuration, and FIG. 3(*b*) shows an enlarged view of a portion in FIG. 3(*a*)

MODE FOR CARRYING OUT THE INVENTION

In the following, an embodiment of the device for counter collision treatment will be described.

Figures 1A, 1B:
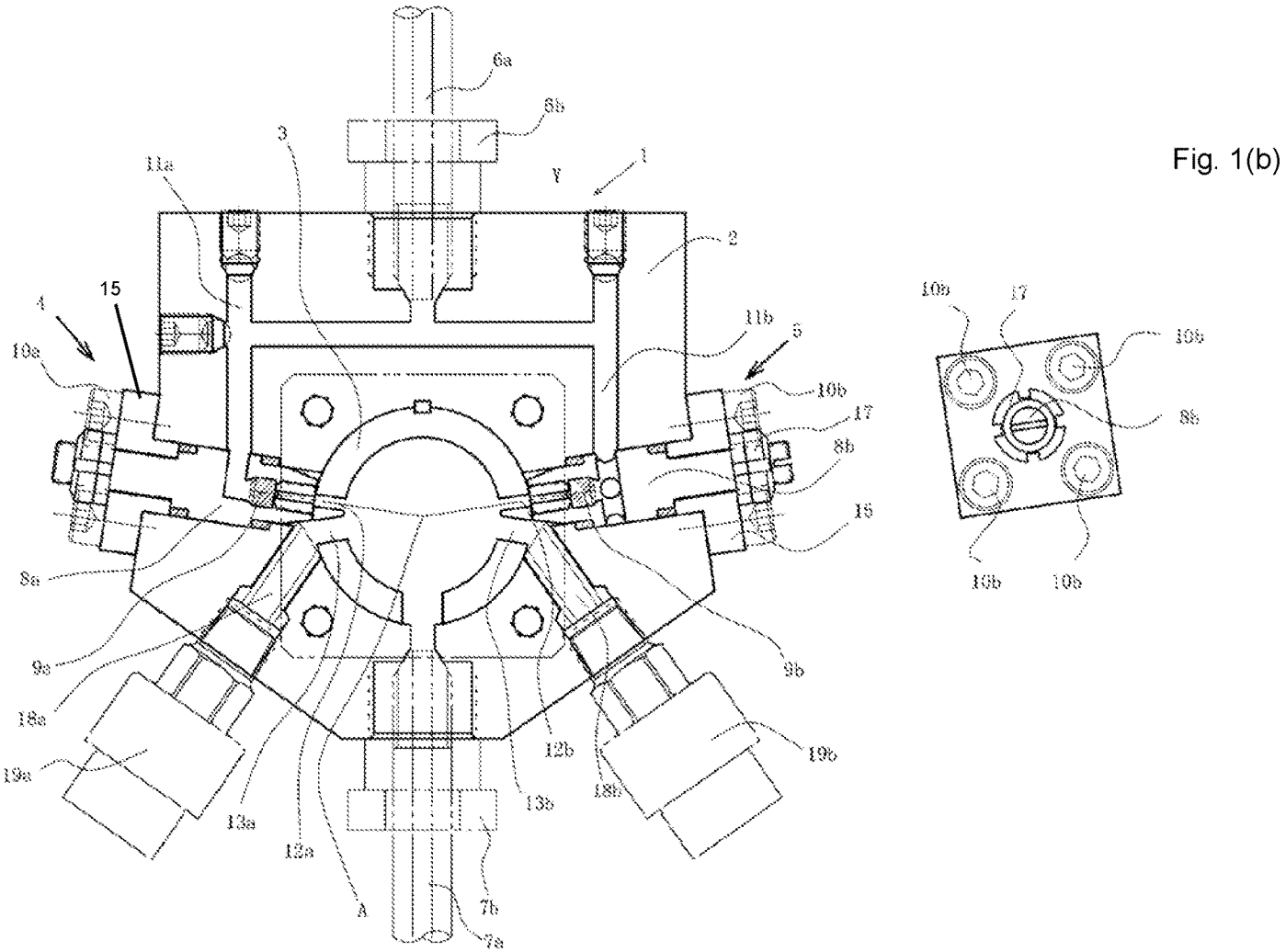
FIG. 1(*a*) is a sectional view of an embodiment of the device for counter collision treatment according to the present invention.

As shown in FIG. 1(*a*), the device for counter collision treatment 1 according to this embodiment comprises a casing 2, a body protective ring 3 in a chamber fixedly disposed in the casing 2, a first nozzle means 4 so disposed as to be capable of supplying a polysaccharide slurry to the body protective ring 3, and a second nozzle means 5, likewise, so disposed as to be capable of supplying a polysaccharide slurry to the body protective ring 3.

In an opening at one end of the casing 2, a pre-treatment fluid supplying tube 6*a* having an inlet for the pre-treatment fluid, i.e., fluid to be treated which is supplied from a tank (not shown) is screw-fitted via a plug 6*b*. In an opening at the other end of the casing 2, a post-treatment fluid discharging tube 7*a* defining an outlet for the post-treatment fluid, i.e., treated fluid which contains minutely fragmented particles resulting from atomization by counter collision in the body protective ring 3 is screw-fitted via a plug 7*b*. In the casing 2, nozzle holders 8*a* and 8*b* are respectively attached to the first nozzle means 4 and the second nozzle means 5, and commercially available nozzle tips 9*a* and 9*b* are respectively attached to the nozzle holders 8*a* and 8*b*. The nozzle holders 8*a* and 8*b* are fixedly attached to the casing 2 each via a nozzle cap 15, respectively with screws 10*a* . . . , 10*b* . . . .

In the casing 2, flow paths 11*a* and 11*b* are formed for respectively connecting the nozzle tips 9*a* and 9*b* to the inlet for the pre-treatment fluid of the pre-treatment fluid supplying tube Ga.

The body protective ring 3 is a cylindrical member with a circular section which is detachably attached to the casing 2 and provided with a pair of injection holes 12*a* and 12*b* passing through the wall of the body protective ring 3 from the outside to the inside. The first nozzle means 4 and the second nozzle means 5 are attached to the casing in such a manner that the injection orifices of the nozzle tip 9*a* and 9*b* are in communication with the pair of injection holes 12*a* and 12*b*, respectively.

The nozzle tips 9*a* and 9*b* are fixedly attached to the first nozzle means 4 and the second nozzle means 5, respectively, in such a manner that each of the nozzle tips 9*a* and 9*b* has an injection angle directed obliquely downward from the horizontal direction at an angle of about 15° and that trajectories of jets from the nozzle tips intersect with each other with an angle at a point in the immediate vicinity of the central axis A of the cylindrical body protective ring 3. Injection angles of the nozzle tips 9*a* and 9*b* are so determined as to be capable of minimizing loss in hydrodynamic force when the two jets are caused to collide at the intersection, and the injection directions are fixed and unchanged. The angle (between the injection directions) which satisfies such requirements may be determined in conformity with the constitution of the device. In this manner, the jets of highly pressurized fluid jetted from the nozzle tips 9*a* and 9*b* are caused to collide with each other to thereby effect homogenization of the fluid such as emulsification of the fluid or dispersion of minute particles in the fluid and/or atomization of particles in the fluid by impact-fragmentation.

Figure 2:
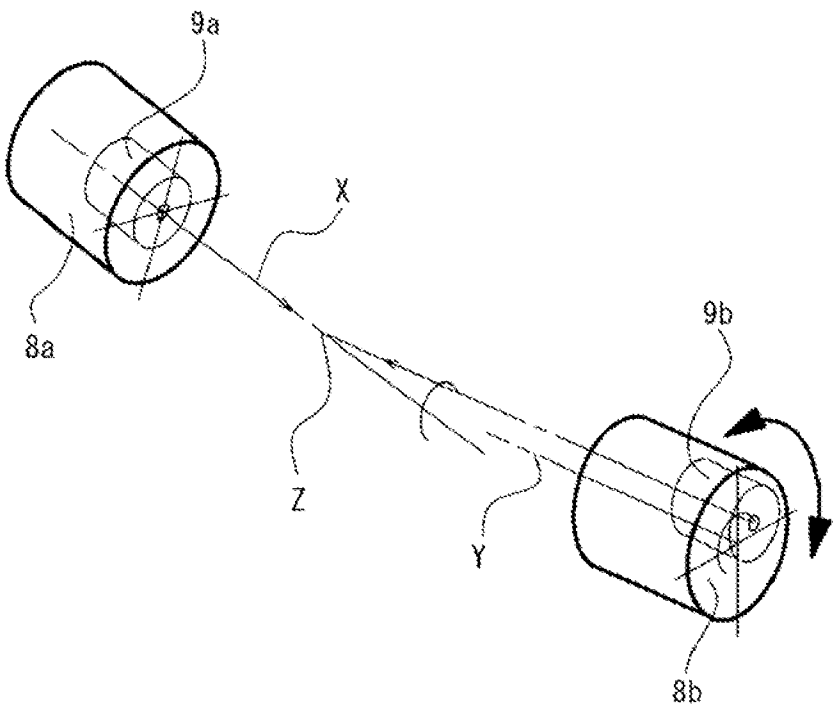
FIG. 2 is an illustrative view showing a manner of operation of the embodiment of the device for counter collision treatment shown in FIG. 1(*a*)

The first nozzle means 4 as one of the first nozzle means 4 and the second nozzle means 5 is fixed relative to the body protective ring 3 and the injection direction X (see FIG. 2). The second nozzle means 5 as the other has a nozzle cap 15 as a turning mechanism for enabling the nozzle tip 9*b* to turn around the fixed injection direction Y as the axis of the turn while keeping the injection direction Y unchanged (see FIG. 2).

In the wall of the body protective ring 3, through holes 13*a* and 13*b* are formed which are located opposite to the injection orifices of the nozzle tips 9*a* and 9*b*, respectively. In communication respectively with the through holes 13*a* and 13*b*, discharge ducts 18*a* and 18*b* each of which is made using a ceramic pipe are externally attached to the body protective ring 3. On end portions of the discharge ducts 18*a* and 18*b*, pressure sensors 19*a* and 19*b* are respectively mounted.

In the device for counter collision treatment according to the above-described embodiment, the highly pressurized fluid introduced from the pre-treatment fluid supplying tube 6*a* reaches the nozzle tips 9*a* and 9*b* respectively through the flow paths 11*a* and 11*b* provided in the casing 2 and is jetted from the nozzle tips toward one point substantially on the central axis A of the body protective ring 3. Consequently, at the one point substantially on the central axis A of the body protective ring 3, jets of the highly pressurized fluid jetted from the nozzle tips 9*a* and 9*b* are caused to collide with each other to thereby lead to homogenization of the fluid such as emulsification of the fluid or dispersion of minute particles in the fluid and/or atomization of particles in the fluid by impct-fragmentation.

Depending on assembly accuracy or the like, however, it is nearly impossible to ensure that the jets from the nozzle tips 9*a* and 9*b* certainly intersect with each other at the one point substantially on the central axis A in the directions capable of obtaining optimum efficiency due to processing accuracy or the like. In general, the nozzle tips are likely to be incorporated out of the intersectional directions capable of obtaining the optimum efficiency.

To cope with this, tests of jetting from the nozzle tips 9*a* and 9*b* are carried out in which the screw 17 for the nozzle cap 15 is loosened and the nozzle holder 8*b* is turned by means of a flathead screwdriver or the like to thereby turn the nozzle tip 9*b* around the injection direction Y as the axis of the turn while keeping the injection direction Y constant and unchanged. Consequently, as shown in FIG. 2, it is found that intersectional point Z, at which injection directions intersect each other with an angle, certainly exists in the immediate vicinity of the central axis A of the cylindrical body protective ring 3, and when the intersectional point Z is found out, the turning is terminated and the nozzle holder 8*b* is fixed by means of the screw 17 at the position.

The intersectional point Z is specifically found out in the following manner.

Into the discharge ducts 18*a* and 18*b* externally attached to the body protective ring 3 in communication with the through holes 13*a* and 13*b* formed in the wall of the body protective ring 3 and located respectively opposite to the injection orifices of the nozzle tips 9*a* and 9*b*, portions of the jets from the nozzle tips 9*a* and 9*b* which reach the discharge ducts without counter-colliding with each other are introduced. Then, the pressure sensors 19*a* and 19*b* mounted on the end portions of the discharge ducts 18*a* and 18*b* detect the time point at which detected pressures are lowest, in other words, the amount of the portions of the jets from the nozzle tips 9*a* and 9*b* that reach the discharge ducts without counter-colliding with each other is smallest. At this timing, the turning of the nozzle holder 8*b* is terminated. In this manner, the intersectional point Z can be digitally detected based on the numerical values of the detected data by means of the pressure sensors 19*a* and 19*b*.

Figure 3A:
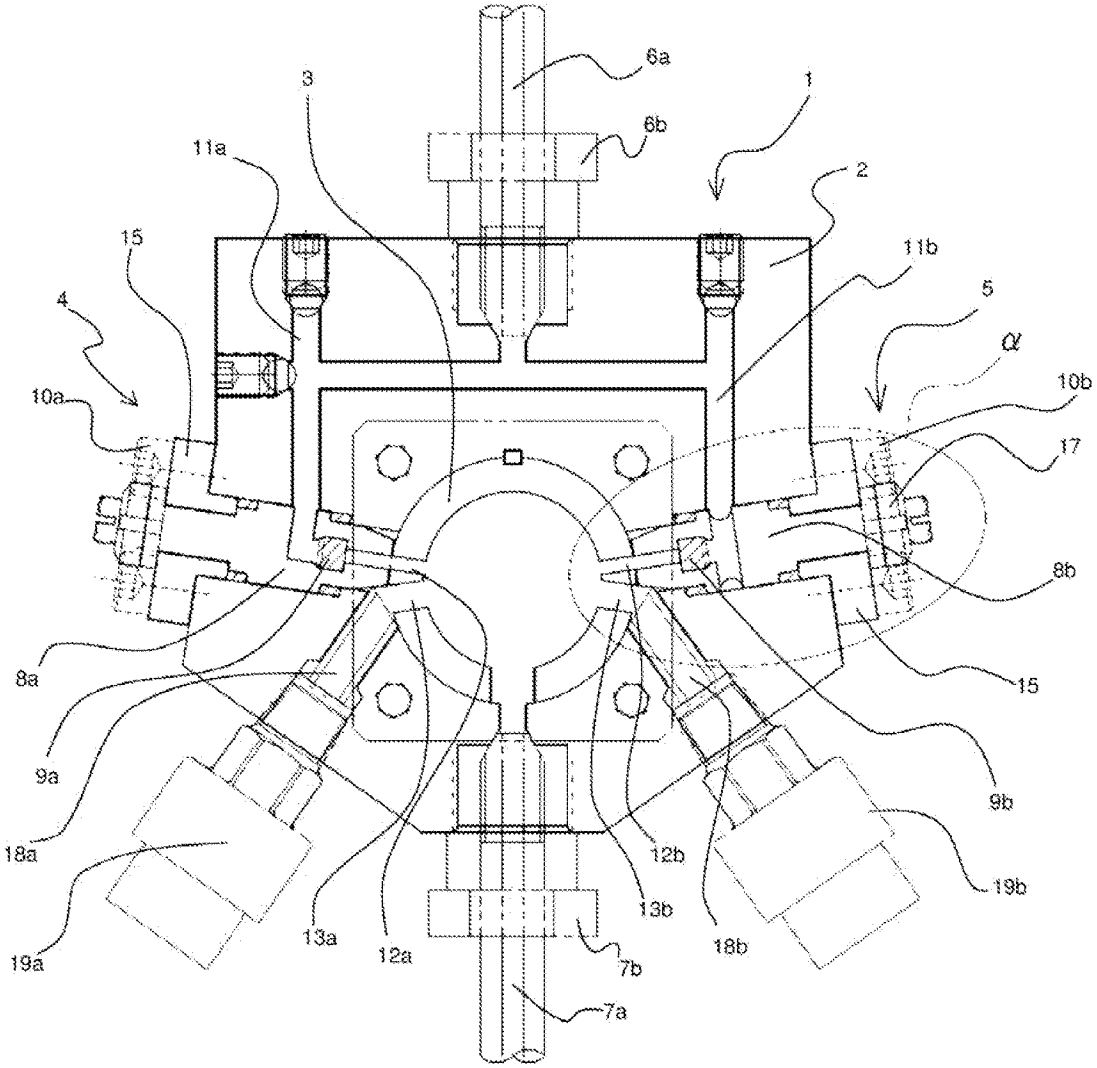
FIGS. 3(*a*) and 3(*b*) are illustrative views of another embodiment of the device for counter collision treatment according to the present invention.
Figure 3B:
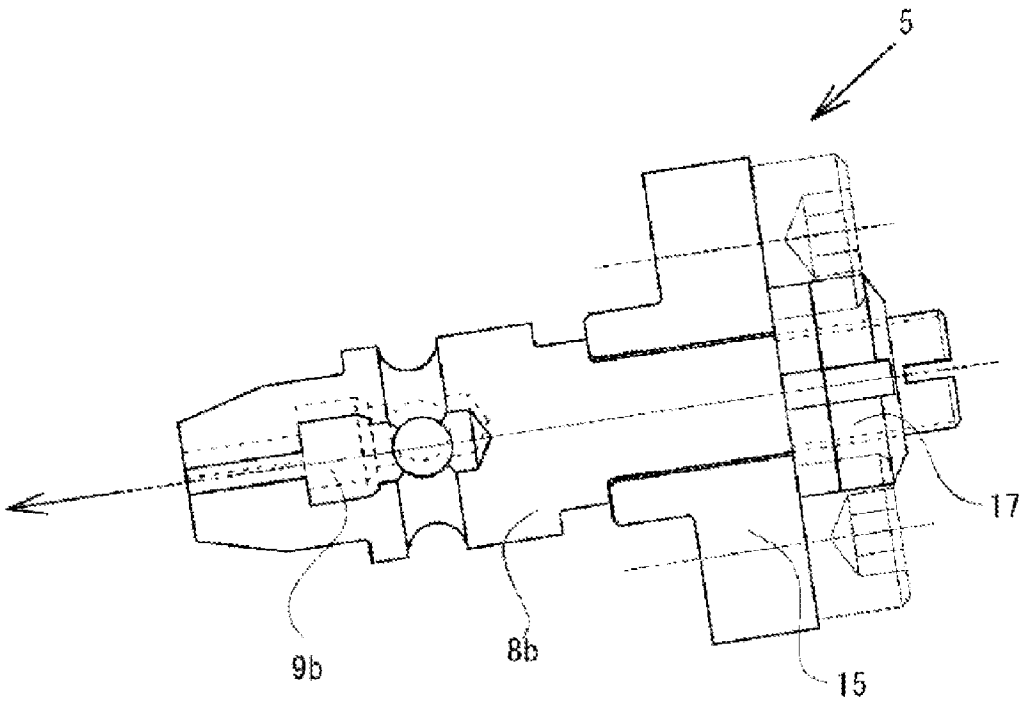
Figure 4:
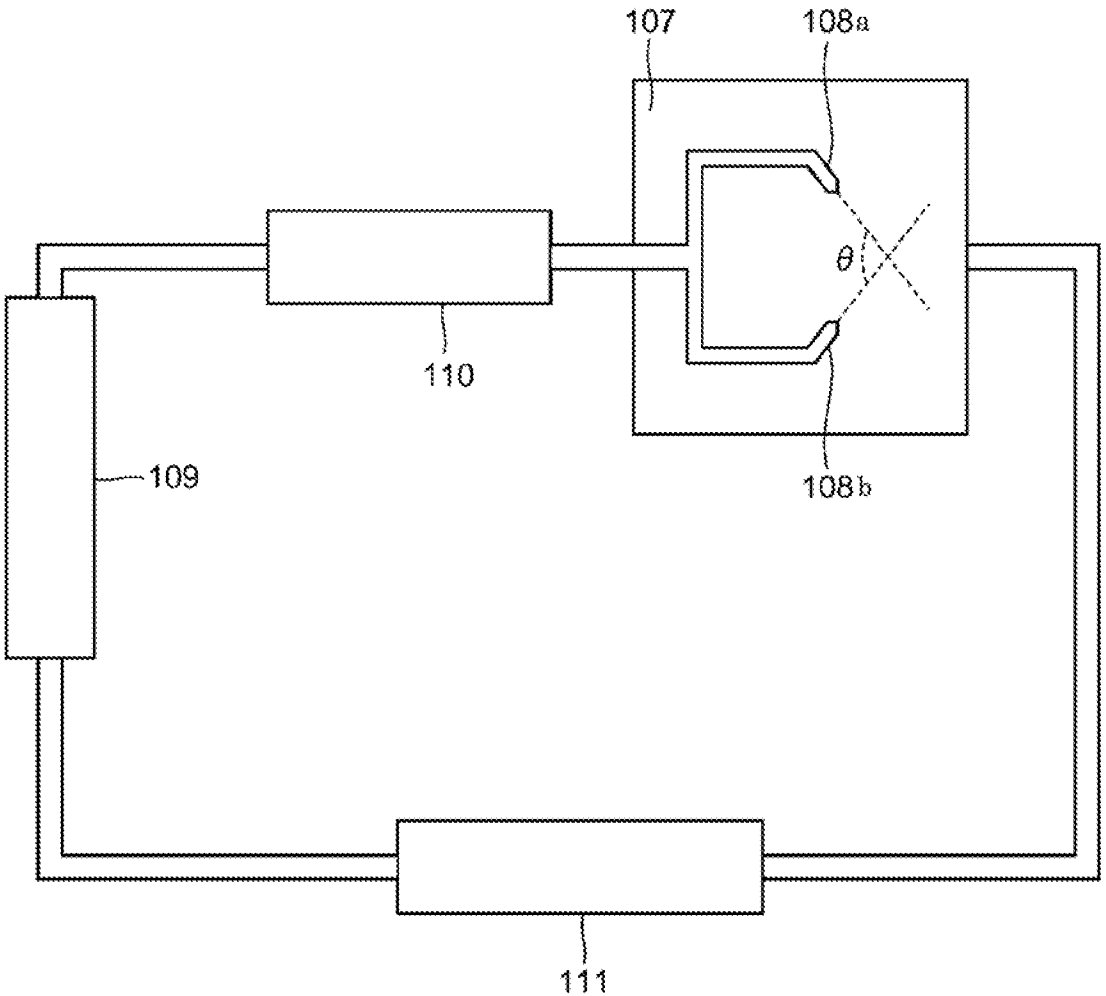
Prior Art Fig. 4
FIG. 4 is a diagram for illustrating a conventional method.

FIGS. 3(*a*) and 3(*b*) are conceptual representations of another embodiment of the device for counter collision treatment according to the present invention.

As shown in FIGS. 3(*a*) and 3(*b*), in this embodiment, the nozzle tip 9*b* in the second nozzle means 5 is disposed intentionally in such an eccentric manner as shown by the dashed line that it is spaced a minute distance apart from the position shown by the solid line which is intended to direct the jet toward the one point substantially on the axis A of the body protective ring 3 in the above-described embodiment.

Likewise the above-described embodiment, also in the device for counter collision treatment according to this embodiment, tests of jetting from the nozzle tips 9*a* and 9*b* are carried out in which the screw 17 for the nozzle cap 15 is loosened and the nozzle holder 8*b* is turned by means of a tool such as a flathead screwdriver or the like to thereby turn the nozzle tip 9*b* around the injection direction Y as the axis of the turn while keeping the injection direction Y constant and unchanged. Consequently, as shown in FIG. 2, it is found that intersectional point Z, at which injection directions intersect each other with an angle, certainly exists in the immediate vicinity of the central axis A of the cylindrical body protective ring 3, and the screw 17 is tightened to terminate the turning of the nozzle holder 8*b* when the intersectional point Z is found out. In this manner, the jets from the injection orifices of the nozzle tips 9*a* and 9*b* are caused to collide with each other at the maximum efficiency With respect to eccentricity of the second nozzle means 5, through operations

NOTE ON REFERENCE NUMBERS

1 . . . device for counter collision treatment
2 . . . casing
3 . . . body protective ring
4 . . . first nozzle means
5 . . . second nozzle means
9*a*, 9*b* . . . nozzle tip
12*a*, 12*b* . . . injection hole
13*a*, 13*b* . . . through hole
A . . . central axis of body protective ring
X, Y . . . injection direction
15 . . . nozzle cap
17 . . . screw
18*a*, 18*b* . . . discharge duct
19*a*, 19*b* . . . pressure sensor

The invention claimed is:

1. A device for counter collision treatment comprising:

a body protective ring; and a first nozzle and a second nozzle that are disposed on opposite sides of a central axis of the body protective ring, so as to inject jets of a highly pressurized fluid into the body protective ring; and are disposed to have injection directions of said first nozzle and said second nozzle intersect at an oblique angle at one point located in front of respective nozzle orifices thereof;

wherein at least one of said first nozzle and said second nozzle is provided with a turning mechanism for enabling the at least one of said first nozzle and said second nozzle to rotate about an axis of rotation while keeping the respective injection direction of the at least one of said first nozzle and said second nozzle unchanged;

wherein the jets of the highly pressurized fluid injected from said first nozzle and said second nozzle are caused to collide with each other to thereby effect homogenization of the highly pressured fluid such that emulsification of the highly pressurized fluid, and/or dispersion of minute particles in the highly pressured fluid, and/or atomization of particles in the highly pressurized fluid is carried out by impact-fragmentation including fragmentation.

2. The device for counter collision treatment according to claim 1, wherein said at least one of said first nozzle and said second nozzle, which is provided with the turning mechanism, is disposed eccentrically apart from a position at which the highly pressurized fluid is jetted toward the one point located in front of respective nozzle orifices, the one point being substantially on the central axis of said body protective ring.

3. The device for counter collision treatment according to claim 1, wherein said body protective ring is provided with through holes respectively disposed to extend in the injection directions of said first nozzle and said second nozzle.

4. The device for counter collision treatment according to claim 1, wherein the body protective ring is provided with pressure sensors disposed respectively downstream from the injection directions of said first nozzle and said second nozzle or at positions downstream of through holes formed in the protective ring, the through holes respectively disposed to extend in the injection directions of said first nozzle and said second nozzle.

5. A method for counter collision treatment which comprises:

arranging a first nozzle and a second nozzle, such that the first nozzle and the second nozzle are disposed on opposite sides of a central axis of a body protective ring, so as to inject jets of a highly pressurized fluid into the body protective ring;

determining injection directions of said first nozzle and said second nozzle so that the jets therefrom intersect at one point located in front of respective nozzle orifices thereof and form an oblique angle; and causing the jets of the highly pressurized fluid injected from said first nozzle and said second nozzle to collide with each other;

wherein one of said first nozzle and said second nozzle is fixedly disposed and the other of said first nozzle and said second nozzle is rotatable about an axis of rotation while keeping the injection direction of the other of said first nozzle and said second nozzle unchanged, thereby allowing for a determination of the location of a collision point between the jets from said first nozzle and said second nozzle.

6. The method for counter collision treatment according to claim 5, wherein the other of said first nozzle and said second nozzle, which is rotatable about the axis of rotation, is disposed eccentrically apart from a position at which the highly pressurized fluid is jetted toward the one point located in front of the respective nozzle orifices, the one point being substantially on the central axis of said body protective ring.

* * * * *